United States Patent [19]

Austin, Jr.

[11] 4,228,899

[45] Oct. 21, 1980

[54] CONTAINER WITH A DISPENSING ORIFICE AND BLANK THEREFOR

[75] Inventor: John J. Austin, Jr., Hinsdale, Ill.

[73] Assignee: Champion International Corporation, Stamford, Conn.

[21] Appl. No.: 15,069

[22] Filed: Feb. 26, 1979

[51] Int. Cl.[3] ..... B65D 5/72

[52] U.S. Cl. ..... 206/626; 229/17 R

[58] Field of Search ..... 229/17 R, 7 R; 206/620, 206/626

[56] References Cited

U.S. PATENT DOCUMENTS

| | | | |
|---|---|---|---|
| 1,756,150 | 4/1930 | Ganz | 229/7 R |
| 2,338,260 | 1/1944 | Ringler | 229/17 R |
| 2,475,677 | 7/1949 | Ringler | 229/17 R |
| 2,654,525 | 10/1953 | Adorney et al. | 229/17 R |
| 2,850,222 | 9/1958 | Hultin | 229/17 R |
| 2,982,461 | 5/1961 | Hultin | 229/17 R |
| 3,269,644 | 8/1966 | Bump | 229/17 R |
| 3,981,430 | 9/1976 | Keim | 229/17 R |

FOREIGN PATENT DOCUMENTS

| | | | |
|---|---|---|---|
| 1171348 | 10/1958 | France | 229/17 R |
| 113441 | 9/1968 | Norway | 229/7 R |
| 466947 | 6/1937 | United Kingdom | 229/17 R |

*Primary Examiner*—Stephen P. Garbe

*Attorney, Agent, or Firm*—Evelyn M. Sommer

[57] ABSTRACT

A multi-sided container, preferably formed of a unitary blank of paperboard, having a frangible perforated line in the center of a front panel defining a dispensing flap and two sets of fold lines radiating away from opposed sides of the perforated line. Once the perforated line is fully severed, pressure on the side panels adjacent the front panel causes the dispensing flap to move away from the front panel to define an enlarged dispensing orifice out of which the contents of the container may be poured. The perforated line has a linear portion and two curvilinear portions in the form of arcs of a circle, some of the radiating fold lines being tangent thereto.

29 Claims, 4 Drawing Figures

CONTAINER WITH A DISPENSING ORIFICE AND BLANK THEREFOR

Figure 1:
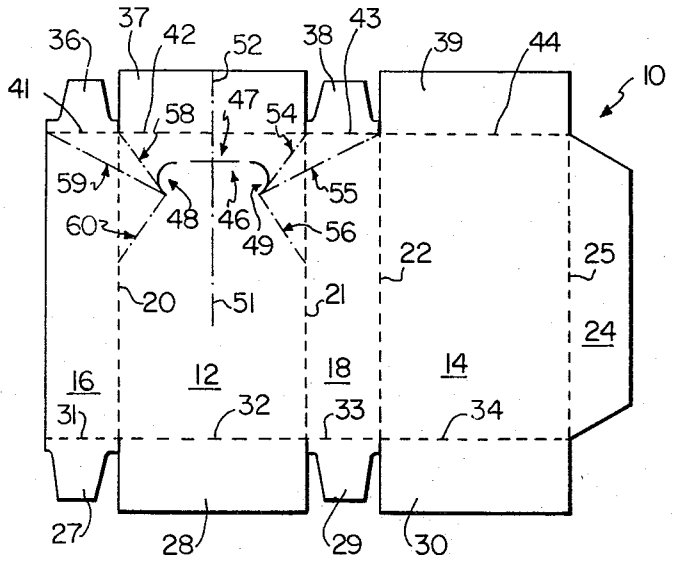

The present invention relates to a container, preferably formed of a unitary blank of paperboard or cardboard, having a dispensing orifice which is formed by severing a frangible perforated line. Once the line is severed and the container squeezed, the contents of the container can be poured therefrom through the orifice. The invention also relates to the configuration of the unitary blank forming the container.

There are presently on the market numerous containers or cartons formed of paperboard or cardboard which contain granular or powdered products, such as candy. These containers usually have either of two types of closures at the tops and bottoms. The first type is a conventional seal closure in which a plurality of flaps are glued or otherwise adhered together. To dispense the product inside the container, these sealed flaps must be severed or the seals broken, which usually prohibits the re-sealing of the flaps and allows possible inadvertent loss of the contents of the container. Another type of closure includes flaps having various interlocking mechanisms so that once the flaps are opened they can be reclosed. However, these types of closures are more expensive to manufacture, including the extra cost of the resealing mechanism, and these types of closures are somewhat more difficult to mechanically close during the container filling operation.

There are also various containers on the market which provide a reclosable dispensing mechanism; however, these usually include a separate part, such as a metal spout, which is expensive and which requires additional steps to apply the spout to the container.

Accordingly, it is a main object of the present invention to overcome the limitations and drawbacks associated with the prior art containers set forth above and to provide a new and improved container having a dispensing orifice therein.

Another object of the present invention is to provide a container having a dispensing orifice in which the container is formed from a unitary blank of material, such as paperboard or cardboard, and in which the top and bottom closures remain sealed.

Another object of the present invention is to provide a container having a dispensing orifice in which the container is economically produced with a minimum amount of material and which can be formed, filled and closed at a high production speed using automated methods.

Another object of the present invention is to provide a container with a dispensing orifice which is very easily opened, as well as being easily and securely closed.

The foregoing objects are basically attained by providing a container comprising a front panel, right and left side panels and a rear panel hingedly connected along parallel fold lines to form an enclosed chamber; a glue flap interconnecting the rear panel and one of the side panels; a bottom closure connected to the bottom of the panels to close the chamber at the bottom; a top closure connected to the top of the panels to close the chamber at the top; and means defining a dispensing flap in the front panel, this means including a frangible perforated line defining a dispensing orifice, whereby once the dispensing flap is manipulated to fully severe the perforated line and form the dispensing orifice pressure applied to the side panels causes the dispensing flap to extend outwardly from the front panel and away from the chamber to expand the dispensing orifice for the pouring out of the contents of the enclosed chamber.

More specifically, the frangible perforated line comprises a straight or linear portion and two curvilinear portions at opposite ends of the linear portion, these curvilinear portions each comprising an arc of a circle. In addition, two sets of a plurality of fold lines are preferably formed in the front panel, each set contacting the perforated line at opposed ends and extending from such contact to opposite sides of the front panel. Each of these sets comprises three fold lines, two of which are tangent to the curvilinear portion, with an angle between the first and second being about 30 degrees, and the angle between the second and third being about 90 degrees. The second fold line, which is in between the first and third, also extends across the adjacent side panel.

Other objects, advantages and salient features of the present invention will become apparent from the following detailed description, which, taken in conjunction with the annexed drawings, discloses a preferred embodiment of the present invention.

Figure 2:
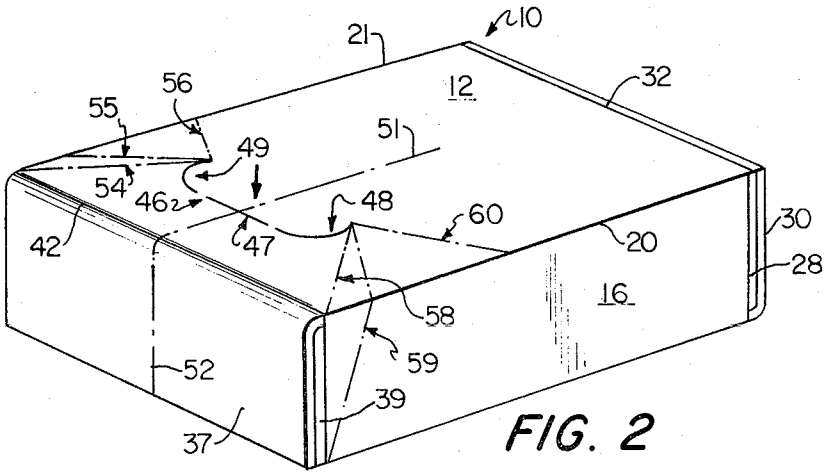
Figure 3:
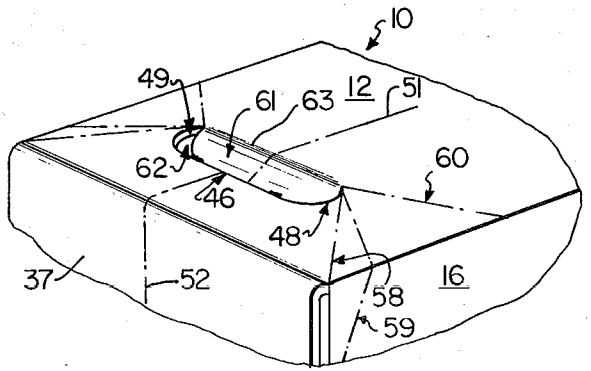
Figure 4:
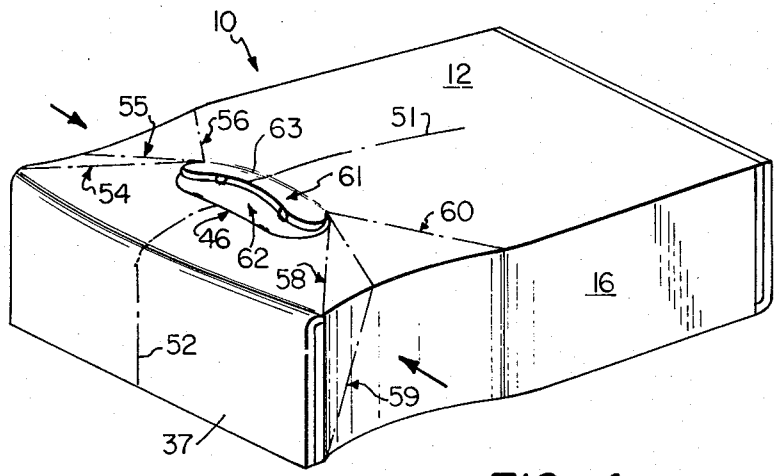

Referring to the drawings which form a part of this original disclosure:

FIG. 1 is a top plan view of the unitary blank adapted to form the container in which the dashed lines of equal length indicate conventional hinge or fold lines separating the various flaps and panels, in which the long and short dashed lines indicate the fold lines which provide for the outward movement of the dispensing flap upon the exertion of a pressure on the side panels and in which the long dashed lines define the perforated line;

FIG. 2 is a right perspective view of the container in accordance with the present invention which has been formed from the unitary blank shown in FIG. 1;

FIG. 3 is a fragmentary, right perspective view of the dispensing flap and dispensing orifice similar to that shown in FIG. 2 except that a downward force has acted on the dispensing flap to fully severe the perforated line defining the flap; and FIG. 4 is a right perspective view of the container shown in FIG. 3 except that pressure has been applied to the side panels and the dispensing flap has pivoted upwardly away from the front panel to expand the dispensing orifice.

Referring now to the drawings in further detail, the unitary blank 10 shown in FIG. 1 is preferably formed of paperboard or cardboard which is thin and foldable. The blank 10 is comprised of a front panel 12, a rear panel 14, a first side panel 16 and a second side panel 18, all of which are rectangular and are hingedly connected respectively along parallel fold or hinge lines 20, 21 and 22. These fold lines are preferably formed in the paperboard blank 10 by means of a light scoring of the paperboard. In addition, a glue flap 24, which can have adhesive thereon, hingedly extends along fold line 25 from the rear panel 14. Of course, this glue flap could also extend from the first side panel 16 or the rear panel 14 could extend from the first side panel 16 instead of as shown in FIG. 1 extending from the second side panel. Panels 12, 14, 16 and 18 have the same length.

Specifically, the first side panel 16 and the second side panel 18 are on opposed sides of the front panel 12, the sides being defined by fold lines 20 and 21. The second side panel 18 is interposed between the sides of the front panel 12 and the rear panel 14. The width and length of the two side panels are the same and the width and length of the front and rear panels are the same. The width of each side panel is about 3/7 the width of the front and rear panels.

At the bottom of these four panels is a bottom closure formed from four bottom closure flaps 27, 28, 29 and 30. The first bottom closure flap 27 hingedly extends along fold line 31 from the bottom of the first side panel 16. The second bottom closure flap 28 hingedly extends along fold line 32 from the bottom of the front panel 12. The third bottom closure flap 29 hingedly extends along fold line 33 from the bottom of the second side panel 18. And, the fourth bottom closure flap 30 hingedly extends along fold line 34 from the bottom of the rear panel 14.

A top closure is formed from four top closure flaps extending from the tops of the panels. Specifically, the first top closure flap 36 hingedly extends along fold line 41 from the top of the first side panel 16. The second top closure flap 37 hingedly extends along fold line 42 from the top of the front panel 12. The third top closure flap 38 hingedly extends along fold line 43 from the top of the second side panel 18. And, the fourth top closure flap 39 hingedly extends along fold line 44 from the top of the rear panel 14.

As seen in FIG. 1, the top and bottom closure flaps associated with the front and rear panels are substantially rectangular in shape and have a width substantially equal to the width of the panels. The four top and bottom closure flaps associated with the side panels have a width which tapers and have a length somewhat shorter than the length of each of the flaps associated with the front and rear panels.

Referring to both FIGS. 1 and 2, a frangible perforated line 46 is provided in the front panel spaced from the top edge or fold line 42 and extends in the center of that panel. This perforated line is formed of a straight or linear portion 47 and left and right curvilinear portions 48 and 49 on opposed ends of the straight portion 47. Preferably, each of these curvilinear portions is in the form of an arc of a circle including approximately from about 130 to 160 degrees. These curvilinear portions curve toward the bottom fold line 32 of the front panel 12 and are spaced from the side fold lines 20 and 21. The arcs on each are such that the linear portion is tangent to each and that a line perpendicular to the linear portion and contacting the end of either of the arcs would define an area between that perpendicular line and the arc. The straight portion 47 is substantially parallel to the top fold line 42 of the front panel 12. The width of the entire perforated line 46 relative to the width of the front panel 12 between fold lines 20 and 21 is about one-half.

As will be described in more detail hereinafter, this perforated line 46 defines the dispensing orifice once it is fully severed and also defines the dispensing flap formed from the material of the front panel 12.

As seen in FIGS. 1 and 2, a fold line 51 extends along the center of the front panel 12 from fold line 42 to a position about two-thirds along the length of the front panel, intersects and bisects the perforated line 46 and intersects and bisects the fold line 42. Similarly, an additional fold line 52 extends along the center of the second top closure flap 37, intersects the fold line 42 and extends from fold line 51 to make a continuous overall fold line.

As best seen in FIG. 1, there are two sets or arrays of fold lines radiating from the two curvilinear portions 48 and 49 of the perforated line 46. The right side array is comprised of a first fold line 54, a second or central fold line 55 and a third fold line 56. The left side array is comprised of a first fold line 58, a second or central fold line 59 and a third fold line 60. Since the configuration and orientation of the left and right side arrays are mirror images, only one will be described in detail.

Thus, the right side array of fold lines 54, 55 and 56 all intersect at one end and contact the right curvilinear portion 49 at that intersection. Preferably, the first fold line 54 and the second fold line 55 are tangent to the curvilinear portion 49. The angle between the first fold line 54 and the second fold line 55 is about 30 degrees, the angle between the second fold line 55 and the third fold line 56 is about 90 degrees, and the angle between the first fold line 54 and the third fold line 56 is about 120 degrees.

The first fold line 54 extends from the curvilinear portion 49 into the right top corner of the front panel 12 formed by the intersection of fold lines 42 and 21. The second fold line 55 extends from the curvilinear portion 49 across the front panel 12, intersects with the right side fold line 21 and continues across the second side panel 18 to the right top corner of that panel formed by the intersection of fold lines 43 and 22. The third fold line 56 extends from the curvilinear portion 49 into contact with the right side fold line 21.

Referring now to FIG. 2, the unitary blank 10 has been formed into a container by a conventional folding of the various flaps and panels along the fold lines set forth above. Preferably, an adhesive is applied to the glue flap 24 to form a sleeve by folding the various panels along their fold lines. Similarly, the top and bottom closure flaps are folded along their fold lines and adhered together to close the top and bottom ends of the container and maintain them closed by such sealing. After the bottom closures are closed and sealed, the container is filled and then the top closures are closed and sealed.

In forming the completed container, the smaller top and bottom closure flaps associated with the side panels are folded over perpendicular to their position shown in FIG. 1 and then the top and bottom closure flaps associated with the front and rear panels are consecutively folded over the smaller closure flaps and sealed in a position perpendicular to the front and rear panels. In the completed container, the front and rear panels are planar, and are parallel and opposed to each other; the side panels are planar, and are parallel and opposed to each other. The side panels are perpendicular to the front and rear panels. The chamber enclosed in the container has rectangular transverse and longitudinal cross-sections.

Referring now to FIGS. 2 and 3, once the container has been formed, the granular or powdered products or contents have been placed inside the container and the closure flaps sealed, the frangible perforated line 46 can be manipulated, such as by a downward pressure applied by a finger as shown by the arrow in FIG. 2 to fully sever the perforated line and form the dispensing orifice.

This is shown in FIG. 3 in which a downward pressure on the dispensing flap 61 provides a full severing of the perforated line 46 and formation of the dispensing orifice 62. As seen in FIG. 3, the dispensing flap 61 is defined by the material on the front panel 12 inside of the area defined by the perforated line 46 and a hinge line 63 running generally between the distal ends of the curvilinear portions 48 and 49 of the perforated line 46. Specifically, the dispensing orifice 64 is defined between the area on front panel 12 adjacent the perforated line 46 and the dispensing flap 61 formed by the downward pressure as seen in FIG. 3.

After the perforated line 46 has been fully severed and the dispensing flap 61 and the dispensing orifice 62 have been formed, a sidewise pressure on the side panels 16 and 18 causes a general deformation of the container along the various fold lines in the front panel 12, the top closure flap 37 and the two side panels 16 and 18 so that the dispensing flap 61 pivots around hinge line 63 and moves outward and away from the front panel 12 and away from the enclosed chamber defined therein. This is shown in FIG. 4 wherein the dispensing flap 61 has been pivoted upwardly and the dispensing orifice 62 has been expanded. This sidewise pressure is exerted by the squeezing action of two fingers, each placed on an opposite side panel adjacent the two fold lines 55 and 59, but on the side of each towards the bottom closures, as indicated by the arrows in FIG. 4. The pressure can also be exerted on fold lines 20 and 21. This expansion of the orifice 62 is greatly facilitated by having the curvilinear portions 48 and 49 as arcs of a circle and by having the arrays of fold lines in the configuration and tangential relationships set forth above.

Once the dispensing flap 61 is in the position shown in FIG. 4, the container is inverted so that the dispensing orifice 62 is on the bottom. At this time the contents of the container can pour out from the container via the dispensing orifice 62. Once the desired amount of the contents has been dispensed from the container, the pressure on the side panels is released. Then the opposed top and bottom ends of the container, formed by the top and bottom closure flaps associated with the front and rear panels, can be squeezed or pressure otherwise applied thereto by a person's fingers and also a downward pressure on the upwardly pivoted dispensing flap 61 can also be exerted. This brings the container substantially back to its configuration shown in FIG. 2 with the side panels substantially planar and with the dispensing flap 61 lying substantially in the plane of the top of the front panel in a position to substantially close the dispensing orifice 62. Thus, the contents are easily dispensed and yet the dispensing flap can be easily returned to its original position, in which the orifice is closed to keep the contents of the container securely therein.

While one advantageous embodiment has been chosen to illustrate the present invention, it will be understood by those skilled in the art that various changes and modifications can be made therein without departing from the scope of the invention as defined in the appended claims.

What is claimed is:

1. A container having a dispensing orifice comprising:

a front panel, right and left side panels and a rear panel hingedly connected along parallel fold lines to form an enclosed chamber;

a glue flap interconnecting said rear panel and one of said side panels;

a bottom closure connected to the bottom of said panels to close the chamber at the bottom;

a top closure connected to the top of said panels to close the chamber at the top; and means defining a dispensing flap in said front panel, said means including a frangible perforated line defining a dispensing orifice, said means further including two sets of a plurality of fold lines formed in said front panel, each set contacting said perforated line at opposed ends and extending from such contact to opposite sides of said front panel with one of said fold lines in each said set extending onto the adjacent side panel, whereby, once said dispensing flap is manipulated to fully sever the perforated line and form the dispensing orifice, pressure applied to said side panels causes said dispensing flap to extend outwardly from said front panel and away from said chamber to expand said dispensing orifice for the pouring out of the contents of said enclosed chamber.

2. A container having a dispensing orifice comprising:

a front panel, right and left side panels and a rear panel hingedly connected along parallel fold lines to form an enclosed chamber;

a glue flap interconnecting said rear panel and one of said side panels;

a bottom closure connected to the bottom of said panels to close the chamber at the bottom;

a top closure connected to the top of said panels to close the chamber at the top; and means defining a dispensing flap in said front panel, said means including a frangible perforated line defining a dispensing orifice, said perforated line being formed by a straight portion and two curved portions at opposed ends of said straight portion, said means further including two sets of a plurality of fold lines formed in said front panel, each set contacting said perforated line at said curved portions and extending from such contact to opposite sides of said front panel, with one of said fold lines in each set being tangent to the associated curved portion, whereby once said dispensing flap is manipulated to fully sever the perforated line and form the dispensing orifice, pressure applied to said side panels causes said dispensing flap to extend outwardly from said front panel and away from said chamber to expand said dispensing orifice for the pouring out of the contents of said enclosed chamber.

3. A container as recited in claim 1 or 2 further including a fold line extending along the center of said front panel, intersecting said perforated line and extending to the top edge of said front panel.

4. A container as recited in claim 1 or 2 wherein said top closure includes a top closure flap hingedly extending from said front panel, and further including a fold line extending along the center of said top closure flap and intersecting the hinge line between said front panel and said top closure flap.

5. A container as recited in claim 1 wherein said perforated line comprises a straight portion and two curved portions at opposed ends of said straight portion.

6. A container as recited in claim 2 or 5 wherein each of said curved portions is in the form of an arc of a circle.

7. A container as recited in claim 2 or 5 wherein each of said curved portions curves away from the top edge of said front panel.

8. A container as recited in claim 1 or 2 wherein each of said sets comprises three fold lines, the included angle between two of said three fold lines being about 120°.

9. A container as recited in claim 1 or 2 wherein each of said sets comprises three fold lines, the included angle between two of said three fold lines being about 30°.

10. A container as recited in claims 1 or 2 wherein each of said sets comprises three fold lines, the included angle between two of said three fold lines being about 90°.

11. A container as recited in claim 2 wherein one of said fold lines in each of said sets extends onto the adjacent side panel.

12. A container as recited in claim 1 wherein each set of fold lines consists of three fold lines including a top, central and bottom fold line, with said top fold line being closest to said top closure and with said bottom fold line being closest to said bottom closure and with said central fold line being disposed intermediate said top and bottom fold lines.

13. A container as recited in claim 12 wherein the fold line which extends onto the adjacent side panel is the central fold line.

14. A container as recited in claim 12 wherein said perforated line comprises a straight portion and two curved portions at opposed ends of said straight portion.

15. A container as recited in claim 14 wherein the central fold line in each of said sets is tangent to one of said curved portions.

16. A container as recited in claim 14 wherein the top fold line in each of said sets is tangent to one of said curved portions.

17. A container as recited in claim 2 wherein each set of fold lines consists of three fold lines including a top, central and bottom fold line with said top fold line being closest to said top closure and with said bottom fold line being closest to said bottom closure and with said central fold line being disposed intermediate said top and bottom fold lines.

18. A container as recited in claim 17 wherein the central fold line in each of said sets extends onto the adjacent side panel.

19. A container as recited in claim 17 wherein the central fold line in each of said sets is tangent to one of said curved portions.

20. A container as recited in claim 17 wherein the top fold line in each of said sets is tangent to one of said curved portions.

21. A unitary blank adapted to be formed into a carton having a dispensing flap defining a dispensing orifice comprising:

a front panel, right and left side panels and a rear panel hingedly connected along parallel fold lines;

a glue flap extending from one of said rear panel and said side panels;

four bottom closure flaps hingedly extending from the bottom of said panels;

first, second, third and fourth top closure flaps hingedly extending respectively from the top of said panels;

a frangible perforated line in said front panel having a substantially linear central portion and left and right curvilinear side portions on opposed sides of said central portion;

a right side array of fold lines intersecting each other and contacting said right curvilinear side portion; and a left side array of fold lines intersecting each other and contacting said left side curvilinear side portion.

22. A blank according to claim 21, and further including a fold line extending along the center of said front panel, intersecting said frangible perforated line and extending along the center of said second top closure flap extending from the top of said front panel.

23. A blank according to claim 21, wherein each of said curvilinear side portions is an arc of a circle.

24. A blank according to claim 21, wherein each of said arrays comprises a first fold line extending respectively into the top corners of said front panel.

25. A blank according to claim 21, wherein each of said arrays comprises a second fold line extending respectively into the right top corners of said side panels.

26. A blank according to claim 21, wherein each of said arrays comprises a third fold line intersecting respectively the opposed side edges of said front panel.

27. A blank according to claim 21, wherein each of said arrays comprises three fold lines, the first and second of said fold lines intersecting at an angle of about 30°, the first and third of said fold lines intersecting at an angle of about 120°, and the second and third of said fold lines intersecting at an angle of about 90°.

28. A blank according to claim 21, wherein at least one of said fold lines in said right side array is tangent to said right curvilinear side portion, and at least one of said fold lines in said left side array is tangent to said left curvilinear side portion.

29. A blank according to claim 21, wherein two of said fold lines in said right side array is tangent to said right curvilinear side portion, and two of said fold lines in said left side array is tangent to said left curvilinear side portion.

* * * * *